US008836173B2

(12) United States Patent
Koch

(10) Patent No.: US 8,836,173 B2
(45) Date of Patent: Sep. 16, 2014

(54) DOMESTIC APPLIANCE HAVING AUTOMATIC SWITCH-OFF

(75) Inventor: Thomas Koch, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 781 days.

(21) Appl. No.: 13/131,645

(22) PCT Filed: Nov. 23, 2009

(86) PCT No.: PCT/EP2009/065595
§ 371 (c)(1),
(2), (4) Date: May 27, 2011

(87) PCT Pub. No.: WO2010/063595
PCT Pub. Date: Jun. 10, 2010

(65) Prior Publication Data

US 2011/0234017 A1 Sep. 29, 2011

(30) Foreign Application Priority Data

Dec. 5, 2008 (DE) ..... 10 2008 044 378

(51) Int. Cl.

| | |
|---|---|
| ***H01H 31/10*** | (2006.01) |
| ***H01H 33/59*** | (2006.01) |
| ***H01H 19/14*** | (2006.01) |
| ***D06F 39/00*** | (2006.01) |
| ***D06F 39/14*** | (2006.01) |
| ***D06F 37/42*** | (2006.01) |
| ***D06F 33/02*** | (2006.01) |
| ***A47L 15/46*** | (2006.01) |
| ***A47L 15/00*** | (2006.01) |

(52) U.S. Cl.

CPC ..... *D06F 39/005* (2013.01); *A47L 2401/20* (2013.01); *A47L 2501/32* (2013.01); *D06F 39/14* (2013.01); *D06F 37/42* (2013.01); *D06F 33/02* (2013.01); *A47L 15/46* (2013.01); *A47L 15/0047* (2013.01)

USPC ..... 307/115

(58) Field of Classification Search
None
See application file for complete search history.

(56) References Cited

U.S. PATENT DOCUMENTS 4,628,443 A * 12/1986 Rickard et al. ..... 700/79
6,425,156 B1 * 7/2002 Knopp et al. ..... 8/159

(Continued)

FOREIGN PATENT DOCUMENTS

DE 1460945 A1 4/1969
DE 1585895 A1 7/1970

(Continued)

OTHER PUBLICATIONS

International Search Report PCT/EP2009/065595.

(Continued)

*Primary Examiner* — Jared Fureman
*Assistant Examiner* — Aqeel Bukhari
(74) *Attorney, Agent, or Firm* — James E. Howard; Andre Pallapies

(57) ABSTRACT

A method and apparatus for autonomously switching off a domestic appliance after completion of a previously selected program is disclosed. The domestic appliance has a control device that executes programs controlling the domestic appliance and an operating unit. The domestic appliance is connected to electrical energy from a power source through circuit arrangement comprising a terminal connection and first and second switches. The first electrical switch is separate from the second switch and can be switched from an open state to a closed state in which the switch is electrically conductive to connect the control device to the electrical energy. The control device is designed to switch the second switch from an open state to a closed state in which the control device is connected to electrical energy through the second switch as soon as the first switch is switched to the closed switching state.

22 Claims, 3 Drawing Sheets

(56) References Cited

U.S. PATENT DOCUMENTS

| | | | | |
|---|---|---|---|---|
| 2007/0034236 | A1 | 2/2007 | Reichold | |
| 2008/0018484 | A1 * | 1/2008 | Sager | 340/628 |
| 2010/0115317 | A1 | 5/2010 | Aurich et al. | |

FOREIGN PATENT DOCUMENTS

| | | | |
|---|---|---|---|
| DE | 3423004 | A1 | 1/1986 |
| DE | 10319132 | A1 | 11/2004 |
| DE | 202006018467 | U1 | 3/2007 |
| EP | 1099790 | B1 | 5/2004 |
| GB | 2048314 | A | 12/1980 |

OTHER PUBLICATIONS

National Search Report DE 10 2008 044 378.6.

* cited by examiner

DOMESTIC APPLIANCE HAVING AUTOMATIC SWITCH-OFF

BACKGROUND OF THE INVENTION

The present invention relates to a circuit arrangement for operating a domestic appliance, which circuit arrangement features a control device for executing programs of the domestic appliance. The invention further relates to a method for operating a control device of a domestic appliance.

Modern domestic appliances, such as washing machines and dryers in particular, are customarily equipped with a program selector which is normally provided as a control panel of rotatably mounted rotary knobs. The aim of the present invention is for these domestic appliances to switch off autonomously after completion of a previously selected program.

The publication DE 20 2006 018 467 U1 discloses a domestic appliance comprising a power switch via which the domestic appliance can be connected to a power supply or disconnected from the power supply. The power switch can be actuated by an operator in this case. The domestic appliance also features a control device which, after completion of a program of the domestic appliance, opens the power switch and hence disconnects the domestic appliance from the power supply.

Furthermore, the publication DE 10 2006 054 539 B3 discloses a method for generating a low-voltage supply of an electrical control device of a domestic appliance. In this case, a power unit can be set to active mode by applying a switching signal to its activation input. In this case, the switching signal is transferred to the power unit via a switch which is provided as a program selector, for example.

The publication DE 103 19 132 A1 describes an operating device for selecting an operating program of a domestic appliance. The operating device comprises a rotary knob which is connected to a magnetic Hall sensor via a shaft. The shaft is mounted such that it can be both rotated and axially displaced. By means of rotating the rotary knob, a magnetic field of the Hall sensor can be caused to change. An evaluation unit receives signals from the Hall sensor. Depending on the signals of the Hall sensor, the evaluation unit deduces the operating program of the domestic appliance as selected by the operator. An axial displacement of the shaft also causes a change in the magnetic field of the Hall sensor. The axial displacement of the shaft and the associated change in the magnetic field can be assigned an additional function, specifically e.g. the function "Pause" or "Stop". In other words, an operator can select an additional function of the domestic appliance by pulling or pushing the rotary knob.

BRIEF SUMMARY OF THE INVENTION

The present invention addresses the problem of reducing the energy consumption of a domestic appliance.

This problem is inventively solved by a circuit arrangement having the features and by a method having the features of the invention. Advantageous embodiments of the invention are specified in the dependent claims.

A domestic appliance is understood to be an appliance that is used for housekeeping. In particular, this can be a large domestic appliance which is designed to execute programs automatically, e.g. a washing machine, a tumble dryer, a dishwasher or a cooking appliance.

A circuit arrangement according to the invention is designed for operating a domestic appliance. The circuit arrangement comprises a control device for executing programs of the domestic appliance, wherein said control device can be supplied with electrical energy from a supply network via a terminal connection of the circuit arrangement. The circuit arrangement comprises a first electrical switch via which the control device can be coupled to the terminal connection and which, depending on an actuation of an operating unit that is connected to the terminal connection, can be switched from an open switching state into a closed switching state, in which the first switch is electrically conductive. The circuit arrangement further comprises a second electrical switch which is connected in parallel with the first switch. In this case, the control device is designed such that, as soon as the first switch is switched into the closed switching state, it switches the second switch from an open switching state into a closed switching state, in which the control device is coupled to the terminal connection via the second switch.

According to the invention, provision is therefore made for the control device of the domestic appliance—depending on the actuation of an operating unit—initially to be started via a first switch, which in particular is only closed for a predetermined time duration, and for the control device autonomously to close a second switch after being started, and therefore to supply itself with electrical energy autonomously. As a consequence, this advantageously enables the control device to open the second switch and therefore to switch itself off automatically after completion of a previously selected program. The overall energy consumption of the domestic appliance is therefore reduced without it being necessary to remodel an existing control panel. In particular, the inventive circuit arrangement can function without an additional power switch (which can be actuated by an operator) and without a bistable relay, these being utilized in the prior art for the purpose of switching off automatically.

The control device preferably comprises a main power unit and a control unit which is supplied with electrical energy via the main power unit. The control unit is preferably designed to execute the programs of the domestic appliance, these being stored in a memory. For example, the control unit can be designed to trigger an electrical drive motor, in particular via a semiconductor switch. In this case, the domestic appliance preferably takes the form of a domestic appliance for the care of laundry items, said appliance featuring a drum which is driven by a drive motor and accommodates the laundry items. The term "domestic appliance" includes in particular washing machines, dryers and washer/dryer combinations in this case.

In order to ensure the automatic switching off of the domestic appliance and hence the reduction in the current consumption, the control device is preferably designed in such a way that, after completing a previously selected program of the domestic appliance, it switches the second switch into the open switching state. This is technically easy to achieve if the second switch is designed as a relay, for example.

According to an embodiment, provision is made for the operating unit to be designed as a program selector for selecting a program of the domestic appliance. The program selector comprises a fixed contact element, in particular a conductive track, and a mobile contact element in this case. The mobile contact element is permanently connected in particular to an actuating element, which can be actuated by an operator, and is electrically coupled to the fixed contact element except in a starting position of the actuating element. In this case, the program selector is provided in particular as a program selector which is rotatably mounted on a control panel of the domestic appliance, i.e. as a rotary knob. In this case, the fixed contact element can be provided as an essentially annular conductive track which features an interruption and on which the mobile contact element slides when the actuating element is rotated. If the actuating element is situated in the starting position, the mobile contact element is preferably arranged over the interruption in the conductive track and is therefore electrically separated from this. As a result of selecting a program from a multiplicity of programs that are available on the domestic appliance, in particular as a result of rotating the actuating element of the program selector, the first electrical switch is therefore switched into the closed switching state in which the control device is switched on and the second electrical switch can close.

A power unit, in particular a capacitor power unit, can preferably be coupled to the terminal connection of the circuit arrangement via the operating unit, said power unit being designed for the purpose of providing an electrical voltage for triggering the first switch. In particular, the power unit comprises a capacitor which is connected to reference potential and from which the available electrical voltage for triggering the first switch can be drawn, and a voltage limiting diode (in particular a Zener diode) by means of which the voltage at the capacitor is limited. Furthermore, the power unit can feature a voltage divider. Provision can be made for the power unit to feature a rectifier (in particular having a diode) by means of which the supply voltage is rectified. The rectified voltage can then be made available at the capacitor for the purpose of triggering the first switch. This means that the power unit is coupled (in particular via the operating unit) to the terminal connection of the circuit arrangement, and therefore to a supply network, and can then provide a D.C. voltage for the purpose of triggering the first switch. By using a power unit, it is possible to achieve operationally reliable triggering of the first switch by means of an electrical pulse.

A control and monitoring unit and/or a pulse generator is preferably coupled to the power unit and the first switch, and is designed to monitor the electrical voltage provided by the power unit and to trigger the first switch depending on the value of the electrical voltage at the time. The functionality of the power unit and of the control and monitoring unit can be such that, for example, the control and monitoring unit only initiates an electrical pulse to the first switch if the capacitor of the power unit is charged or if the voltage available at the capacitor reaches a predefinable value. The first switch can then be switched into the closed switching state for the time duration of the electrical pulse. During the time duration of the delivered pulse, i.e. while the first electrical switch remains closed, the control device preferably closes the second switch and thus autonomously supplies itself with electrical voltage. The control and monitoring unit is preferably provided as an integrated circuit (microchip) and comprises in particular one or more switches, in particular transistors, which are used for initiating the electrical pulse to the first switch. By using the control and monitoring unit, the first switch can be triggered as required and reliably after actuation of the operating unit.

The control and monitoring unit preferably features a reset input, via which a reset signal that causes an electrical pulse to be initiated can be sent to the control and monitoring unit, wherein said reset signal can be generated by actuating the operating unit. The control device can therefore be started by actuating the operating unit, in particular by rotating the actuating element of the program selector by at least one position, even after a program of the domestic appliance has been completed. A standby mode of the control device is provided thus, in which it no longer consumes any active current, but can still be switched on again at any time by actuating the operating unit. In this embodiment, provision can be made for the reset input of the control and monitoring unit to be electrically coupled to a further mobile contact element, this being connected to the actuating element of the operating unit. In this way, provision can be made for a plurality of fixed and separately arranged contact elements, of which one contact element in each case is contacted with the mobile contact element upon actuation of the operating unit, in particular upon rotation of the actuating element of the program selector. If the multiplicity of fixed contact elements is coupled to a reference potential, in particular to ground, the reset input of the control and monitoring unit is in contact with the reference potential for a short time duration when the operating unit is adjusted. In other words, if the operating unit is actuated, a reset signal (in the form of a low signal, i.e. ground) is sent to the reset input of the control and monitoring unit, which causes the delivery of the electrical pulse to the first switch.

It proves to be particularly advantageous if the first switch is designed as a semiconductor switch, in particular an Opto-MOS relay, or as a relay. This means that the time duration for which the first switch is conductively connected can be set or predefined as required, depending on the response time of the control device when closing the second switch. If a semiconductor switch or relay is used, it is possible to trigger the same without great effort by simply delivering electrical pulses.

According to a further embodiment, provision is made for a third electrical switch, which is connected in parallel with the second switch and allows the control device to be coupled to the terminal connection, wherein the control device is designed to switch the third switch into a closed switching state as a result of the mechanical locking of a door of the domestic appliance. If a selected program of the domestic appliance is started, the door of the domestic appliance is automatically locked by the control device and the third switch is simultaneously closed. In this case, the third switch remains closed for the time duration during which the door of the domestic appliance remains locked. This ensures that the control device remains electrically coupled to the terminal connection of the circuit arrangement even if a power failure occurs on the supply network side. In this way, a program (of the domestic appliance) which has already started and is interrupted by the power failure can be completed correctly when the supply voltage is resumed.

According to a further aspect of the invention, provision is made for a domestic appliance, in particular for the care of laundry items, which comprises a circuit arrangement according to the invention or a preferred embodiment thereof.

An inventive method for operating a control device of a domestic appliance is set forth, wherein programs of the domestic appliance are executed by means of said control device. As part of the method, the control device is supplied with electrical energy from a supply network via a terminal connection of the circuit arrangement, when a first electrical switch is switched into a closed switching state depending on actuation of an operating unit which is connected to the terminal connection. The method provides for a second electrical switch, which is connected in parallel with the first switch and via which the control device is coupled to the terminal connection, to be switched into a closed switching state as required by means of the control device as soon as the first switch is switched into the closed switching state.

The preferred embodiments which are proposed with reference to the inventive circuit arrangement, and in particular their advantages, apply correspondingly to the inventive method.

Further features of the invention are derived from the claims, the figures and the description of the figures. The present features and combinations of features cited in the description and the features and combinations of features cited below in the description of the figures and/or shown solely in the figures can be used not only in the specified combination, but also in other combinations or individually without thereby departing from the scope of the invention.

BRIEF DESCRIPTION OF THE DRAWINGS

The invention is explained below in greater detail with reference to individual preferred exemplary embodiments and with reference to the appended drawings, in which.

DETAILED DESCRIPTION OF EXEMPLARY EMBODIMENTS OF THE PRESENT INVENTION

Identical and functionally identical elements are denoted by the same reference signs in the figures.

Figure 1:
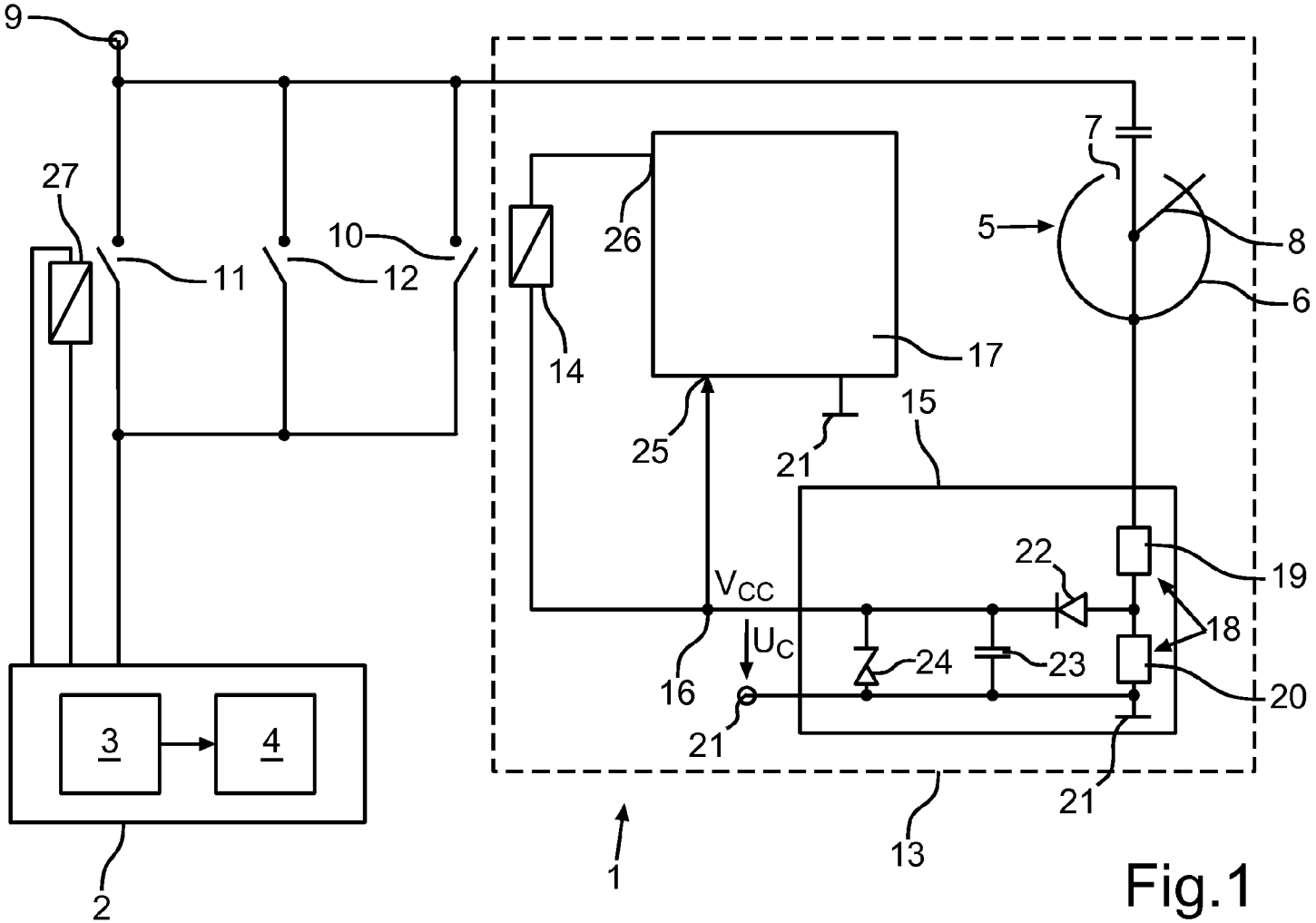
FIG. 1 shows a schematic illustration of a circuit arrangement according to a first exemplary embodiment of the invention.

FIG. 1 shows a schematic illustration of a circuit arrangement 1 which is used for operating a domestic appliance, this being a washing machine in the example. The circuit arrangement 1 features a control device 2 which, as schematically indicated in FIG. 1, features a main power unit 3 and a control unit 4 that is supplied by the main power unit 3. The control unit 4 is used e.g. for the purpose of triggering a drive motor, by means of which a drum for accommodating laundry items is driven. In this case, the drive motor can be supplied via a triac, for example, which again can be triggered by means of the control unit 4. The control unit 4 can also be designed to trigger further electrical consumer units such as in particular pumps, heater elements and the like. The control unit 4 is therefore designed to execute programs of the washing machine, said programs being stored in the control device 2, e.g. in a memory.

In order to allow selection of a program by an operator, the circuit arrangement 1 comprises a program selector 5 which features an actuating element (not shown in the figures) that can be actuated by an operator. The program selector 5 features a fixed contact element 6, which is embodied here as an essentially annular conductive track with an interruption 7. A mobile contact element 8 is rotatably connected by means of the rotatable actuating element and slides on the conductive track 6 except in a starting position of the actuating element. In the starting position of the actuating element, the mobile contact element 8 is arranged over the interruption 7 of the conductive track 6, such that no electrical connection exists between the mobile contact element 8 and the conductive track 6. If the actuating element is moved from the starting position into a different position among a plurality of different positions, the mobile contact element 8 is electrically coupled to the conductive track 6.

The circuit arrangement 1 can be electrically coupled to a supply network via a terminal connection 9 (phase conductor), i.e. the circuit arrangement 1 (or more precisely the control device 2) can be supplied with electrical energy via the terminal connection 9. In the present example, the control device 2 can be coupled to the terminal connection 9 and hence to the supply network via three separate electrical switches, specifically a first electrical switch 10, a second electrical switch 11, and a third electrical switch 12.

The first switch 10 is triggered by means of a trigger circuit 13 which features the program selector 5. In this case, the first switch 10 is provided as a relay in the first exemplary embodiment illustrated in FIG. 1. If electrical current flows via a control element 14 of the first switch 10, the first switch 10 is closed. If no current flows via the control element 14, the first switch 10 is open. The control element 14 can be designed as a coil in this case.

The trigger circuit 13 features a capacitor power unit 15 which is coupled on one side to the conductive track 6 of the program selector 5 and on the other side to a control and monitoring unit 17 via a terminal 16. The capacitor power unit 15 comprises a voltage divider 18 which includes a first and a second ohmic resistor 19, 20. The second ohmic resistor 20 is connected to ground 21 in this case. A supply voltage of the supply network can be reduced by means of the voltage divider 18. Connected downstream of the voltage divider 18 is a rectifying diode 22 by means of which the supply voltage is rectified. The capacitor power unit 15 further comprises a capacitor 23 which couples the terminal 16 to ground 21 and at which an electrical voltage $U_C$ for the first switch 10 can be provided. The voltage $U_C$ is limited by means of a Zener diode 24, which couples the terminal 16 to ground 21. The voltage $U_C$ is e.g. 3 V or 5 V when the capacitor 23 is charged.

The voltage $U_C$ that is present at the capacitor 23 is monitored by means of the control and monitoring unit 17. For this purpose, the terminal 16 is coupled to a monitoring input 25 of the control and monitoring unit 17. This means that the control and monitoring unit 17 can detect whether the voltage $U_C$ has reached a predefinable value $V_{CC}$, i.e. whether the capacitor 23—when the actuating element of the program selector is rotated from the starting position—is charged.

The control element 14 of the first switch 10 is coupled on one side to the terminal 16, at which the voltage $U_C$ is provided, and on the other side to a terminal connection 26 of the control and monitoring unit 17. The control and monitoring unit 17 then has the task, when the voltage $U_C$ reaches the predefinable value $V_{CC}$ (e.g. 3 V or 5 V), of connecting the control element 14 to ground 21, such that current flows via the control element 14. The control and monitoring unit 17 is connected to ground 21 for this purpose and comprises, for example, a switch such as in particular a transistor via which the control element 14 can be coupled to ground 21. The control and monitoring unit 17 is therefore used to cause current pulses to be output to the control element 14 in order to close the first switch 10. This can only take place if the capacitor 23 is charged and/or the voltage $U_C$ has reached the predefinable value $V_{CC}$.

The second electrical switch 11 is provided as a simple relay in the present example. The second switch 11 can be triggered by means of the control device 2 via a control element 27. The control element 27 can be provided in the form of a coil here. If an electrical current flows via the control element 27, the second switch 11 is closed. This current flow can be caused by the control device 2.

In the present example, the third electrical switch 12 is closed by means of the control device 2 at the same time as a door of the domestic appliance is locked. In this case, the third switch 12 remains closed until the door is mechanically unlocked after completion of a previously selected program of the domestic appliance. If a power failure occurs on the supply network side, the control device 2 is supplied with electrical energy via the third switch 12 after the voltage returns. In this way, it is possible to complete a previously selected and started program of the domestic appliance autonomously after a power failure.

The functionality of the circuit arrangement 1 according to FIG. 1 is explained below in further detail. If the actuating element of the program selector 5 is rotated from the starting position, an electrical connection is established between the mobile contact element 8 and the conductive track 6 and hence between the capacitor power unit 15 and the terminal connection 9. The control and monitoring unit 17 then monitors the voltage $U_C$ that is present at the capacitor 23. If the voltage $U_C$ reaches the predefinable value $V_{CC}$ or if the capacitor 23 is fully charged, the control and monitoring unit 17 establishes an electrical connection between the control element 14 of the first switch 10 and the ground 21. A current then flows via the control element 14, specifically for the time duration of a pulse, e.g. for the time duration of approximately 3 s. For this time duration, the first switch 10 is in the closed state, i.e. it is electrically conductive.

At the same time, the control device 2 is coupled to the terminal connection 9 of the circuit arrangement 1 via the first switch 10 and is supplied with electrical energy by the supply network. The control device 2 can now switch the second electrical switch 11 into the closed switching state; this is achieved by applying current to the control element 27. In this case, the control device 2 closes the second switch 11 during the time duration of the pulse that is initiated to the first switch 10, i.e. during the three seconds and therefore when the first switch 10 remains closed. When the three seconds (i.e. the time duration of the current pulse that is delivered to the control element 14) expires, the first switch 10 opens. The second switch 11 remains closed for the duration of the previously selected program.

If the selected program of the domestic appliance is finished, the control device 2 switches the second switch 11 into the open switching state. This takes place at the time point at which the program is completed. In this way, it is ensured that control device 2 does not consume any further active current after completion of the program. Consequently, the energy consumption of the domestic appliance is reduced overall.

Figure 2:
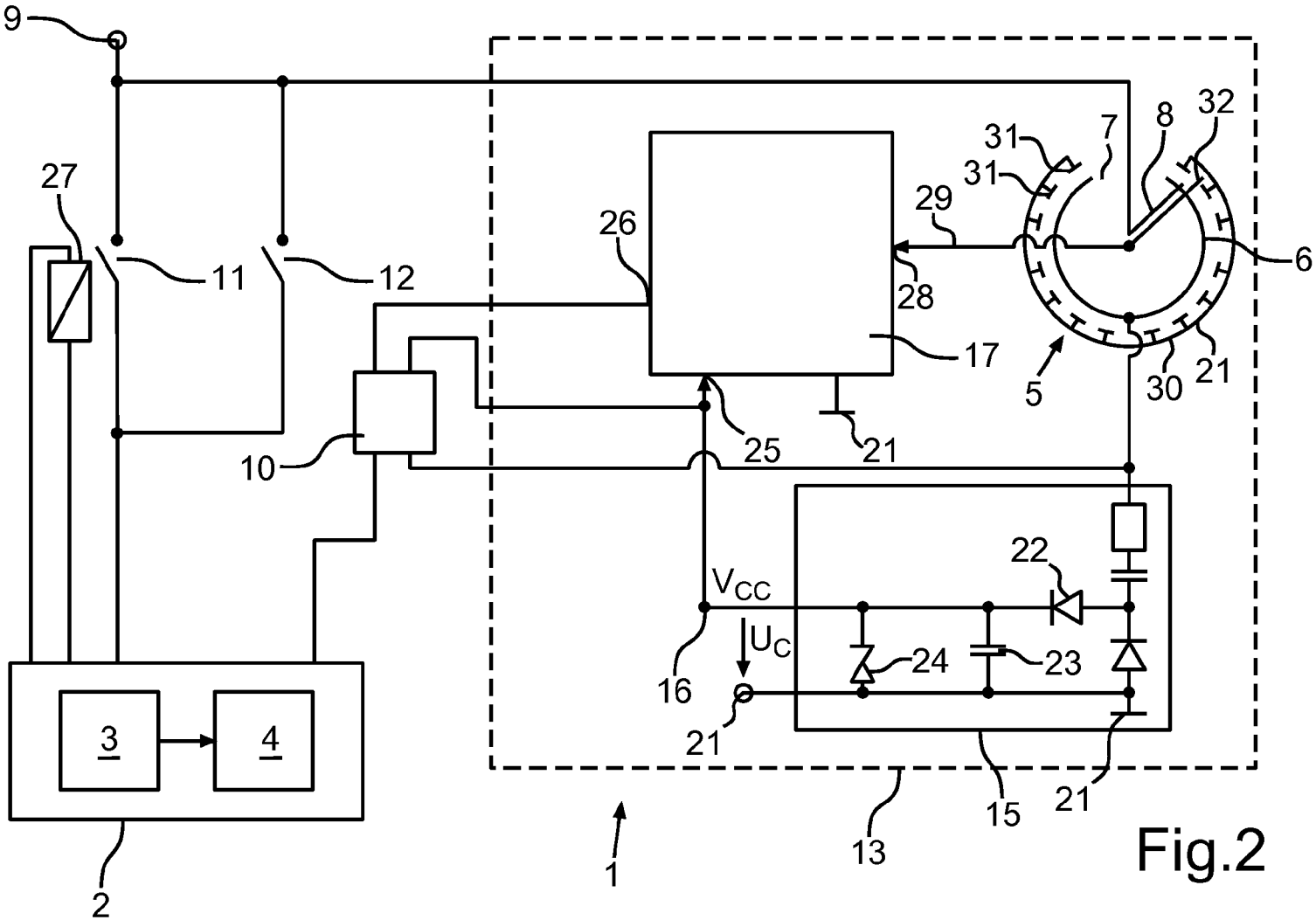
FIG. 2 shows a schematic illustration of a circuit arrangement according to a second exemplary embodiment of the invention.

The circuit arrangement 1 according to a second exemplary embodiment of the invention is depicted in FIG. 2. The circuit arrangement 1 according to the second example corresponds essentially to that in the first example, and therefore only the differences are explained in the following.

In the second exemplary embodiment, the first switch 10 is provided as an OptoMOS relay. This means that the first switch 10 comprises a light-emitting diode (LED) on its primary side, which LED triggers a MOSFET transistor that is arranged on its secondary side. Provision is therefore made for a wear-free switch 10.

In the second exemplary embodiment, the control and monitoring unit 17 comprises a reset input 28, via which a reset signal 29 can be supplied to the control and monitoring unit 17, thereby initiating or causing the output of a current pulse to the first switch 10 and hence to the closure of the same. In the example, the pulse to the first switch 10 is initiated when the reset input 28 is coupled to ground 21, i.e. subjected to a low signal.

It is now intended to ensure that even after completion of a program, i.e. when the control device 2 is switched off, said control device 2 can be started again by simply rotating the program selector 5. For this purpose, the program selector 5 is provided with a second fixed and essentially annular conductive track 30 comprising a plurality of contact elements 31 which are arranged circumferentially at intervals. These contact elements 31 are electrically coupled together via the conductive track 30 and are connected to ground potential 21. A further mobile contact element 32 is connected in a non-rotatable manner to the actuating element of the program selector 5, and is decoupled or separated from the fixed contact elements 31 in the respective positions of the actuating element. Only when the actuating element is rotated does the mobile contact element 32 initially touch a fixed contact element 31 in this case, then to detach itself from this fixed contact element 31 when a further position of the actuating element is reached. Consequently, the reset input 28 of the control and monitoring unit 17 is briefly connected to ground 21 when the actuating element is rotated, i.e. the reset signal 29 is evaluated with regard to the initiation of a pulse to the first switch 10. If it is established by means of the monitoring input 25 that the capacitor 23 is charged, a current pulse is output to the first switch 10 after the actuating element is rotated by at least one position. Consequently, the control device 2 can be started autonomously after completion of a program.

Although the power unit 15 of the trigger circuit 13, as illustrated in FIG. 2 according to the second exemplary embodiment, to some extent comprises different components than the power unit 15 according to FIG. 1, the functionality of the power unit 15 nonetheless remains identical in the second exemplary embodiment. For example, a capacitor is connected between the conductive track 6 and the diode 22 FIG. 2, while said capacitor is connected between the terminal connection 9 and the program rotary selector 5 in FIG. 1. Moreover—in contrast with FIG. 1—the first switch 10 in FIG. 2 is connected between the program selector 5 and the control device 2, whereas it is connected directly between the terminal connection 9 and the control device 2 in FIG. 1. The first switch 10 according to the second exemplary embodiment, having the form of an OptoMOS relay, is therefore completely decoupled from the supply voltage in the starting position of the program selector.

Figure 3:
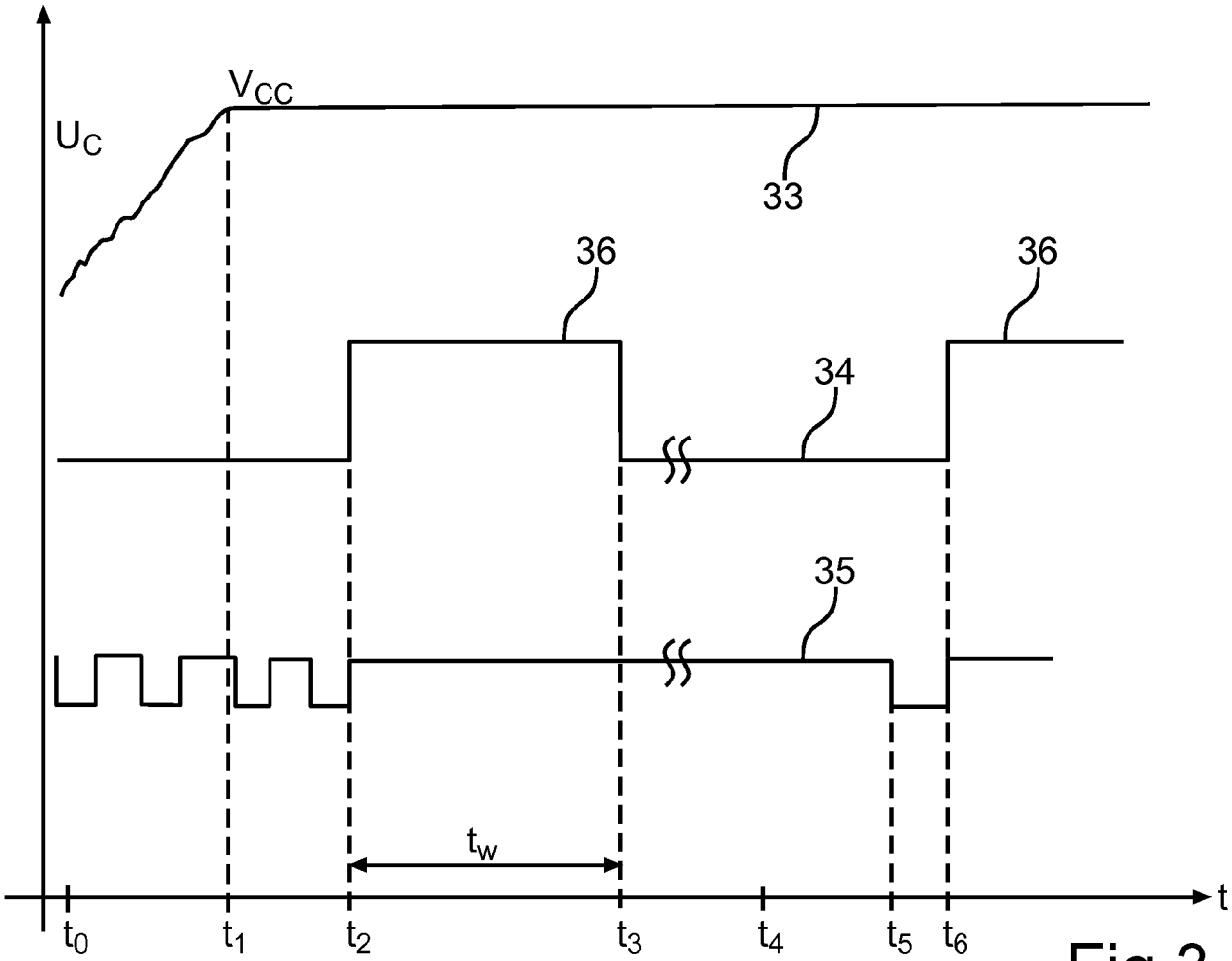
FIG. 3 shows a temporal profile of an electrical voltage which is present at a capacitor of a power unit after rotation of an actuating element of a program selector, a temporal profile of electrical pulses initiated to a first electrical switch by means of a control and monitoring unit, and a temporal profile of a reset signal which is sent to a reset input of the control and monitoring unit.

With reference to FIG. 3, an explanation is now given of signals that occur at relevant inputs 25, 26, 28 of the control and monitoring unit 17. The upper part of FIG. 3 illustrates a profile 33 of the voltage $U_C$ which is present at the capacitor 23, specifically as a function of the time t which is plotted on the x-axis. The center of FIG. 3 illustrates a temporal profile 34 of the current flows delivered to the first switch 10, i.e. current pulses occurring at the terminal connection 26. Finally, the lower part of FIG. 3 illustrates a temporal profile 35 of the reset signal 29 which occurs at the reset input 28.

If the actuating element of the program selector 5 is rotated from the starting position into a different position, the voltage $U_C$ begins to rise at a time point $t_0$. This is monitored by the control and monitoring unit 17. The voltage $U_C$ which is present at the capacitor 23 reaches the value $V_{CC}$ at a time point $t_1$, this being detected by the control and monitoring unit 17 accordingly. As long as the actuating element of the program selector 5 is rotated, the reset input 28 is closed to ground 21 in a pulsed manner, which can be seen with reference to the profile 35 until a time point $t_2$. Approximately at the time point $t_2$, i.e. when the voltage $U_C$ which is present at the capacitor 23 has reached the value $V_{CC}$, the control and monitoring unit 17 causes an output of a current pulse 36 to the first switch 10, such that this becomes electrically conductive. This current pulse 36 is output for the duration of a time interval $t_W$, after which the current pulse 36 dies away at a time point $t_3$. After the time point $t_3$, a supply of electrical energy to the control device 2 is ensured via the second switch 11. A time point $t_4$ in FIG. 3 represents the time point at which a previously selected program of the domestic appliance is completed. At this time point $t_4$, the second switch 11 is therefore switched into the open switching state and the control device 2 is switched off.

It is nonetheless possible to switch control device 2 on again by simply rotating the actuating element of the program selector 5. If the actuating element of the program selector 5 is situated in a previously selected position at a time point $t_5$ and in an adjacent position at a time point $t_6$ (i.e. the actuating element is rotated by one position), the reset input 28 of the control and monitoring unit 17 is connected to ground 21 for the duration of the time interval between $t_5$ and $t_6$. This is evaluated by the control and monitoring unit 17 to the effect that a further current pulse 36 is output to the first switch 10 at the time point $t_6$ and the first switch 10 is closed.

The invention therefore provides a circuit arrangement 1 which allows both a reduction in the current consumption after completion of a program and the possibility of switching the control device 2 on again by means of actuating the program selector 5. The described circuit arrangement 1 functions without a bistable relay and without an additional power switch as used in the prior art. It is a further advantage of the circuit arrangement that the existing control panels need not be remodeled in order to allow the functionality of the circuit arrangement 1.

The invention claimed is:

1. A circuit arrangement for operating a domestic appliance, comprising:

a control device for executing programs of the domestic appliance;

a terminal connection, through which the domestic appliance can be supplied with electrical energy from a supply network;

a first electrical switch, said control device being adapted to be coupled to the terminal connection through said first electrical switch;

an operating unit connected to the terminal connection, said operating unit selecting programs for said control device, said operating unit having a fixed contact element and a mobile contact element, said mobile contact element being adapted to move relative to the fixed contact element when the operating unit is actuated by an operator, said mobile contact element being electrically coupled to the fixed contact element when the operating unit is not in a starting position, said first electrical switch being switched from an open state to a closed state in which the first switch is electrically conductive in response to an actuation of the operating unit; and a second electrical switch, said first and second electrical switches being separate from each other, said control device being adapted to be coupled to the terminal connection through said second switch, said second switch being switched from an open state to a closed state in which the control device is coupled to the terminal connection through the second switch as soon as the first switch is switched to the closed state.

2. The circuit arrangement of claim 1 wherein said control device is adapted to switch the second switch to the open state after of a program of the domestic appliance is completed.

3. The circuit arrangement of claim 1 wherein the second switch is a relay.

4. The circuit arrangement of claim 1, further comprising a power unit adapted to be coupled to the terminal connection through the operating unit, said power unit being adapted to provide an electrical voltage to switch said first switch.

5. The circuit arrangement of claim 4 wherein the power unit is a capacitor power unit.

6. The circuit arrangement of claim 4, further comprising a control and monitoring unit coupled to said power unit and to said first switch, said control and monitoring unit being adapted to monitor electrical voltage provided by the power unit, said control and monitoring unit being adapted for initiating an electrical pulse for switching the first switch in response to a change in the value of said monitored electrical voltage.

7. The circuit arrangement of claim 6 wherein said control and monitoring unit is adapted to initiate an electrical pulse to switch said first switch when the electrical voltage provided by the power unit reaches a predetermined value.

8. The circuit arrangement of claim 7 wherein said electrical pulse has a duration ($t_W$), and said first switch is switched to the closed switching state for the duration ($t_W$) of said electrical pulse.

9. The circuit arrangement of claim 6 wherein a reset signal is generated by actuating said operating unit and said control and monitoring unit includes a reset input such that said reset signal causes said electrical pulse to be initiated when said reset signal is applied to said reset input.

10. The circuit arrangement of claim 7 wherein the first switch is one of a semiconductor switch or a relay.

11. The circuit arrangement of claim 7 wherein the first switch is an OptoMOS relay.

12. The method of claim 11 wherein the domestic appliance includes a door having a mechanical lock, and a third electrical switch adapted to be switched by the control device, said third electrical switch being connected in parallel with the second switch and adapted to couple the control device to the terminal connection, said method further comprising the steps of:

mechanically locking the door; and switching the third switch into a closed state in response to the mechanical locking of the door, so that the third electrical switch electrically couples said control device to said terminal connection in response to the mechanical locking of the door.

13. The circuit arrangement of claim 7 wherein the domestic appliance has a door that is locked mechanically, said circuit arrangement further comprising a third electrical switch electrically connected in parallel with the second switch, said control device being adapted to switch said third switch into a closed state so that said third electrical switch electrically couples said control device to said terminal connection in response to the mechanical locking of said door.

14. A method for operating a control device of a domestic appliance including an operating unit having a starting position that can be selected by an operator and a fixed and a mobile electrical contact, said control device being electrically connected to a circuit arrangement having a terminal connection and first and second electrical switches, the first and second electrical switches being separate from each other, said operating unit selecting programs of the domestic appliance for execution, said control device executing said programs, said method comprising the steps of:

switching the first electrical switch to a closed state in response to an actuation of the operating unit;

supplying the control device with electrical energy from a supply network via the terminal connection of the circuit arrangement when the first electrical switch is switched to a closed state;

switching the second electrical switch to a closed state so that the control device is coupled to the terminal connection through the second electrical switch as soon as the first switch is switched to the closed state;

electrically coupling the fixed contact element and the mobile contact element when the operating unit is not in a starting position.

15. The method of claim 14, said method further comprising the step of:

selecting a program of the domestic appliance by actuating the operating unit.

16. The method of claim 14 wherein a power unit is coupled to the terminal connection through the operating unit, and the power unit is coupled to the first switch through a control and monitoring unit, said method further comprising the steps of:

initiating an electrical pulse in response to an actuation of the operating unit, the pulse being initiated by the control and monitoring unit; and switching the first switch to the closed state in response to the electrical pulse initiated by the control and monitoring unit;

maintaining the first switch the closed state for the duration of the electrical pulse;

switching the second switch to the closed state during the electrical pulse; and maintaining the second switch in the closed state for the duration of a previously selected program of the domestic appliance.

17. The method of claim 14 further comprising the step of:

switching the second switch is to the open state after completion of a program of the domestic appliance, the second switch being switched to the open state after completion of a program of the domestic appliance using the control device.

18. The method of claim 17 wherein the control and monitoring unit includes a reset input, said method further comprising the step of:

supplying a reset signal to the reset input of the control and monitoring unit when the operating unit is actuated, said reset signal causing the electrical pulse to be initiated by the control and monitoring unit.

19. The method of claim 14 wherein a power unit is adapted to be coupled to the terminal connection through the operating unit and to the first switch, said method further comprising the step of:

switching said first switch using an electrical voltage from said power unit.

20. The method of claim 19 wherein a power unit is adapted to be coupled to the terminal connection through the operating unit and to the first switch through a control and monitoring unit that monitors the electrical voltage provided by the power unit, said method further comprising the steps of:

monitoring the electrical voltage provided by the power unit; and switching said first switch in response to the value of the monitored electrical voltage.

21. The method of claim 19 wherein a power unit is adapted to be coupled to the terminal connection through the operating unit and to the first switch through a control and monitoring unit that monitors the electrical voltage provided by the power unit, said method further comprising the steps of:

monitoring the electrical voltage provided by the power unit; and initiating an electrical pulse for switching said first switch when the monitored electrical voltage reaches a predetermined value.

22. The method of claim 21, said method further comprising the step of:

maintaining the first switch in the closed state for the duration ($t_W$) of the electrical pulse.

* * * * *